US009889689B2

(12) United States Patent
Furuta

(10) Patent No.: US 9,889,689 B2
(45) Date of Patent: Feb. 13, 2018

(54) PRINTING APPARATUS AND PRINTING METHOD

(71) Applicant: SEIKO EPSON CORPORATION, Tokyo (JP)

(72) Inventor: Tatsuo Furuta, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/337,755

(22) Filed: Oct. 28, 2016

(65) Prior Publication Data

US 2017/0136792 A1 May 18, 2017

(30) Foreign Application Priority Data

Nov. 12, 2015 (JP) ..... 2015-221879

(51) Int. Cl.
*B41J 25/308* (2006.01)
*B41J 25/00* (2006.01)
*B41J 19/20* (2006.01)

(52) U.S. Cl.
CPC ..... *B41J 25/006* (2013.01); *B41J 25/308* (2013.01); *B41J 25/3088* (2013.01); *B41J 19/202* (2013.01)

(58) Field of Classification Search
CPC ..... B41J 25/006; B41J 25/308; B41J 25/312; B41J 25/3086; B41J 2/08; B41J 2/16517; B41J 2/18
See application file for complete search history.

(56) References Cited

U.S. PATENT DOCUMENTS 5,065,169 A * 11/1991 Vincent ..... B41J 19/00 346/139 C
2004/0246284 A1* 12/2004 Murai ..... B41J 19/202 347/8
2005/0152726 A1* 7/2005 Ueda ..... B41J 25/308 400/56
2007/0064029 A1* 3/2007 Edwards ..... B41J 25/308 347/8
2009/0058895 A1* 3/2009 Kida ..... B41J 25/308 347/8
2011/0249049 A1* 10/2011 Taira ..... B41J 19/145 347/9
2013/0271518 A1* 10/2013 Morita ..... B41J 2/07 347/8

(Continued)

FOREIGN PATENT DOCUMENTS

JP 2010-280119 A 12/2010

*Primary Examiner* — Patrick King
(74) *Attorney, Agent, or Firm* — Global IP Counselors, LLP

(57) ABSTRACT

A printing apparatus includes a carriage on which a print head is mounted and that discharges an ink from the print head while moving the carriage along a predetermined direction and further includes a space width adjustment unit that causes a width of a space above the carriage within the printing apparatus to be larger in an acceleration region in which the carriage is accelerated from a stopped state than in a constant velocity region in which the carriage is moved at a constant velocity after the acceleration region. The space width adjustment unit causes the width of the space above the carriage in the constant velocity region to be smaller than or equal to a paper gap that is a distance between the carriage and a print medium which is below the carriage and which receives the ink discharged from the print head.

6 Claims, 5 Drawing Sheets

(56) References Cited

U.S. PATENT DOCUMENTS

2015/0314619 A1* 11/2015 Tanami ..... B41J 19/207
347/39
2015/0375543 A1* 12/2015 Barnett ..... B41J 2/04516
347/37

* cited by examiner

PRINTING APPARATUS AND PRINTING METHOD

BACKGROUND

1. Technical Field

The present invention relates to a printing apparatus and a printing method.

2. Related Art

An ink jet printer includes a carriage on which a print head is mounted and discharges ink from the print head while moving the carriage along a predetermined main scanning direction. Due to this, the ink lands on a print medium, realizing printing. When the carriage moves along the main scanning direction, the carriage accelerates from a stopped state, subsequently moves at a constant velocity, and then decelerates to stop. The print head discharges ink during any one of these states of acceleration, constant velocity movement, and deceleration.

Furthermore, in the ink jet printer, when nozzles of the print head discharge ink, discharge of ink drops (main drops) is sometimes accompanied by discharge of drops smaller than main drops which are called satellites or the like. The satellites are also termed the subsidiary drops. Furthermore, in some cases, a discharged ink drop (main drop) partially breaks apart in the air to form subsidiary drops. A subsidiary drop can join a main drop in the air or can land at a position that overlaps the landing position of a main drop, so that the subsidiary drop may sometimes be substantially visually unrecognizable in the print result. On the other hand, a subsidiary drop may land apart from main drops on a print medium. Such a variation in the relation between the landing positions of a main drop and a subsidiary drop varies the area covered by the ink on the print medium and therefore affects the image quality of the print result.

Incidentally, JP-A-2010-280119 describes an ink jet recording apparatus in which air control windows provided at two ends of the movement range of the carriage are opened and closed by using shutters in accordance with the moving direction and acceleration/deceleration of the carriage so as to control the flow of air between the recording head and the recording medium.

Subsidiary drops are lighter in weight than main drops and therefore more strongly affected by airflows when flying. In the range in which the carriage can be moved, an acceleration region in which the carriage accelerates while moving and a constant velocity region in which the carriage moves at a constant velocity are different from each other in the quantity and speed of airflow that occurs between the carriage and the print medium. Therefore, in the related art, the positional relation between main drops and subsidiary drops at the time of landing is likely to differ between the acceleration region and the constant velocity region, so that density difference (density unevenness) sometimes occurs in print result between the two regions. For example, in the acceleration region, main drops and subsidiary drops tend to land in an overlapping state on the print medium whereas in the consent velocity region, main drops and subsidiary drops tend to land apart from each other on the print medium.

Furthermore, print results produced by the related-art ink jet printers sometimes exhibit a kind of image quality degradation that is called ripple. Concretely, as a nozzle discharges ink, swirling airflow occurs in the vicinity of the nozzle and affects the flight of the ink discharged from other nozzles so that their landing positions deviate. Such deviation results in color deviation or unevenness being visually recognized as a kind of image quality degradation (ripple).

Note that the ink jet printer of JP-A-2010-280119 mentioned above, because of using detour spaces at the two ends of the movement range of the carriage, can be said to be able to achieve the advantageous effects only by moving the carriage to the two ends so as to use the air flowing between the detour spaces and the movement range. Furthermore, because JP-A-2010-280119 provides detour spaces at the two ends of the movement space of the carriage, the drawback of increasing the transverse width of the apparatus is conceivable regarding this technology.

SUMMARY

An advantage of some aspects of the invention is that a printing apparatus and a printing method that realize good image quality by restraining density unevenness and ripple are provided.

One aspect of the invention provides a printing apparatus that includes a carriage on which a print head is mounted and that discharges an ink from the print head while moving the carriage along a predetermined direction. The printing apparatus includes a space width adjustment unit that causes a width of a space above the carriage within the printing apparatus to be larger in an acceleration region in which the carriage is accelerated from a stopped state than in a constant velocity region in which the carriage is moved at a constant velocity after the acceleration region.

According to this aspect of the invention, the space width adjustment unit makes the width of the space above the carriage larger in the acceleration region for the carriage than in the constant velocity region. Because of this, the acceleration region does not have a difference in the airflow that occurs in the space below the carriage from the constant velocity region. Therefore, the positional relation between main drops and subsidiary drops at the time of landing becomes substantially the same between the acceleration region and the constant velocity region, so that the aforementioned density unevenness is not exhibited. Moreover, because the width of the space above the carriage is made smaller in the constant velocity region for the carriage than in the acceleration region, airflow that occurs in the space below the carriage can be sufficiently secured. Therefore, the swirling airflow that is likely to occur some time after the carriage starts to move is restrained, so that the aforementioned ripple is not exhibited.

In an embodiment of the foregoing aspect of the invention, the space width adjustment unit may cause the width of the space above the carriage in the constant velocity region to be smaller than or equal to a paper gap that is a distance between the carriage and a print medium which is below the carriage and which receives the ink discharged from the print head.

According to this embodiment, in the constant velocity region, the width of the space above the carriage is made smaller than or equal to the paper gap so as to cause sufficient airflow to occur in the space below the carriage, so that ripple can be restrained.

In another embodiment of the foregoing aspect of the invention, the space width adjustment unit may include a movable wall that is moved toward above the carriage according to speed of movement of the carriage.

According to this embodiment, the width of the space above the carriage can be adjusted by moving the movable wall according to the speed of movement of the carriage.

In still another embodiment of the foregoing aspect of the invention, the space width adjustment unit may include an erectable portion that is erected toward above the carriage by receiving head wind that occurs according to the movement of the carriage.

According to this embodiment, the width of the space of the carriage can be adjusted by allowing the erectable portion to be erected by the wind force according to the movement of the carriage.

In a further embodiment of the foregoing aspect of the invention, at least a portion of the space width adjustment unit may be a ceiling surface of a space in which the carriage moves and the ceiling surface may have a shape in which a range that corresponds to the constant velocity region is protruded downward.

According to this embodiment, the width of the space above the carriage can be adjusted by the shape of the ceiling surface of the space in which the carriage moves.

The technical idea of the invention can also be realized in a form other than a product that is the printing apparatus. For example, a printing method in which an ink is discharged from a print head mounted on a carriage while the carriage is moved in a predetermined direction, the printing method including causing a width of a space above the carriage within an apparatus to be larger in an acceleration region in which the carriage is accelerated from a stopped state than in a constant velocity region in which the carriage is moved at a constant velocity after the acceleration region, can also be regarded as the invention.

BRIEF DESCRIPTION OF THE DRAWINGS

The invention will be described with reference to the accompanying drawings, wherein like numbers reference like elements.

DESCRIPTION OF EXEMPLARY EMBODIMENTS

Exemplary embodiments of the invention will be described hereinafter with reference to the accompanying drawings. The drawings show mere examples for describing the exemplary embodiments.

Figure 1:
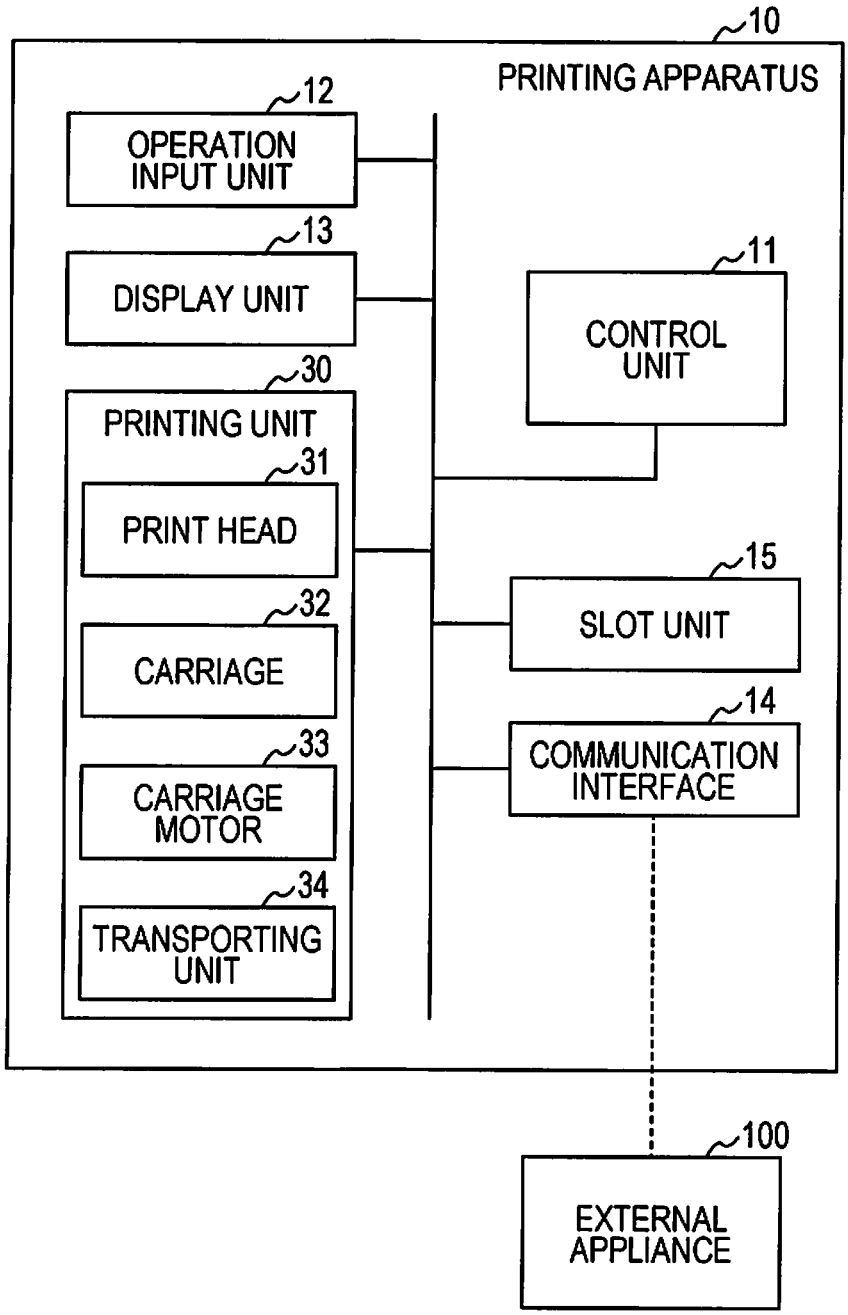
FIG. 1 is a block diagram exemplifying an apparatus construction of an exemplary embodiment of the invention.

FIG. 1 exemplifies functions of a printing apparatus 10 and the like according to an exemplary embodiment of the invention by a block diagram. The printing apparatus 10 can be considered as, for example, a product such as a printer or a multifunction machine that includes a plurality of functions of a printer, a scanner, a facsimile, etc. The printing apparatus 10 may be called a recording apparatus, a liquid discharge (ejection) apparatus, etc. The printing apparatus 10 realizes a printing method according to the invention. In FIG. 1, the printing apparatus 10 is exemplified as a construction that includes a control unit 11, an operation input unit 12, a display unit 13, a communication interface (I/F) 14, a slot unit 15, a printing unit 30, etc.

The control unit 11 is constructed of, for example, an IC (integrated circuit) that has a CPU (central processing unit), a ROM (read-only memory), a RAM (random access memory), etc., and other storage media, etc. The control unit 11 controls behaviors of various constructions or components of the printing apparatus 10 by the CPU executing computational processings according to programs (firmware) stored in the ROM or the like through the use of the RAM or the like as a work area. Note that when there are a plurality of devices (an IC or the like) that control the various constructions that the printing apparatus 10 includes, these devices may be collectively termed the control unit 11 or portions of the devices may be termed the control unit 11.

The operation input unit 12 includes various buttons and keys for accepting operations performed by a user. The display unit 13 is a portion for showing various kinds of information regarding the printing apparatus 10 and is constructed of, for example, a liquid crystal display (LCD). Part of the operation input unit 12 may be realized as a touch panel that is displayed in the display unit 13.

The printing unit 30 is a mechanism for printing images on a print medium under the control of the control unit 11. When the printing method adopted by the printing unit 30 is an ink jet method, the printing unit 30 includes various constructions such as a print head 31, a carriage 32 on which the print head 31 is mounted and which moves along a predetermined main scanning direction, a carriage motor 33 that produces motive power for moving the carriage 32, and a transporting unit 34 that transports the print medium along a transport direction that intersects with the main scanning direction.

In the vicinity of a gear train (not graphically shown in the drawings) that transmits motive power from the carriage motor 33 to the carriage 32 and the like, an encoder (not graphically shown), for example, a rotary encoder, is provided. This encoder generates a pulse signal that has a cycle commensurate with the rotation speed of the carriage motor 33. On the basis of the pulse signal from the encoder, the control unit 11 computes the velocity of the movement of the carriage 32 commensurate with the present rotation speed of the carriage motor 33 (hereinafter, termed the carriage velocity (or speed)). Furthermore, the control unit 11 feedback-controls the driving of the carriage motor 33 at every short time (control step) so that the acceleration, constant velocity movement, and deceleration of the carriage 32 accord with a predetermined velocity profile. This control of the carriage motor 33 will be hereinafter expressed as the control of the carriage velocity.

The print head 31 is supplied with ink from an ink cartridge (not graphically shown). More specifically, the print head 31 is supplied with a plurality of kinds of inks (e.g., a cyan ink, a magenta ink, a yellow ink, a black ink, etc.) from a plurality of ink cartridges that are provided separately for each of the inks. The ink cartridges may be mounted on the carriage 32 or may also be mounted at a predetermined site within the printing apparatus which is not on the carriage 32. The print head 31 has a plurality of nozzles and is capable of discharging (ejecting) ink from each nozzle as the carriage 32 moves. The inks discharged (in the form of main drops and subsidiary drops as mentioned above) land on a print medium so as to realize the printing on the print medium. The print head may also be called the printing head, the recording head, the liquid discharging (ejecting) head, etc.

The transporting unit 34 includes rollers for supporting and transporting a print medium, motors for rotating the rollers, etc. (none of which is graphically shown). A representative example of the print medium is paper. However, in this exemplary embodiment, the concept of the print medium includes not only paper but also any other material as long as the material allows the recording of a liquid and is capable of being transported by the transporting unit 34.

The communication I/F 14 is a collective term for interfaces for connecting the printing apparatus 10 to an external appliance 100 by wire or wirelessly. The external appliance 100 may be various appliances that can input to the printing apparatus 10 data for use for printing, including smart phones, tablet-type terminals, digital still cameras, personal computers (PCs), etc. The printing apparatus 10 is capable of connecting, via the communication I/F 14, to the external appliance 100 by various communication standards and measures, for example, a USB cable, a wired network, a wireless LAN, an electronic mail communication, etc. The slot unit 15 is a portion for inserting an external storage medium such as a memory card. That is, the printing apparatus 10 allows data stored in an external storage medium, such as a memory card, inserted in the slot unit 15 to be input from that external storage medium.

Figure 2:
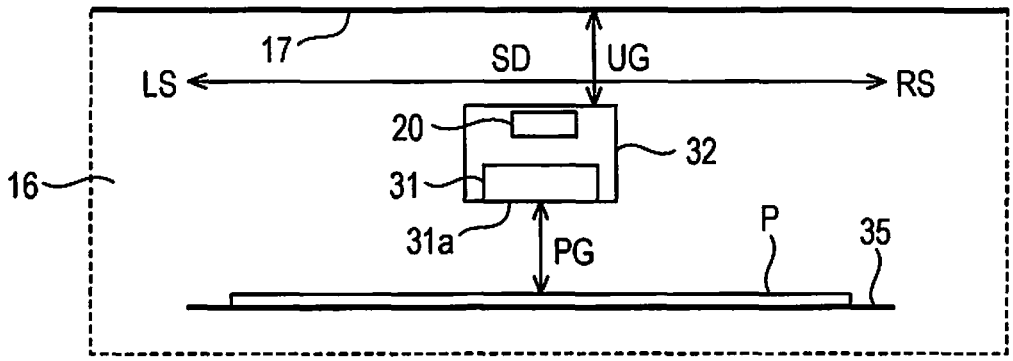
FIG. 2 is a diagram plainly illustrating a construction of portions that are within a print space.

FIG. 2 plainly shows a construction of portions that are in a space (print space 16) within the printing apparatus 10. Within the print space 16, the carriage 32 moves along a guide rail (not graphically shown) that lies in the main scanning direction SD. That is, the carriage 32 is capable of moving from one end side LS to the other end side RS in the main scanning direction SD and moving from the other end side RS and the one end side LS. The print head 31 mounted on the carriage 32 has its nozzle surface 31*a* exposed downward. Note that the up-down directions with regard to the construction of the printing apparatus 10 are defined with reference to the up-down directions determined when the printing apparatus 10 is placed on an arbitrary horizontal plane. The nozzle surface 31*a* is provided with a plurality of nozzles.

A platen 35 is disposed below the carriage 32. The print medium P is transported onto the platen 35 by the transporting unit 34. In FIG. 2, the transport direction in which the print medium P is transported is a direction perpendicular to the plane of the drawing. The distance (height) of the carriage 32 (the nozzle surface 31*a*) in the up-down direction from the print medium P laid on the platen 35 is a paper gap (hereinafter, termed the space width PG). Above the carriage 32 there is a ceiling surface 17 that closes the print space 16 from above. The ceiling surface 17 is, for example, a lid that separates the print space 16 and a space outside the printing apparatus 10 from each other. Alternatively, in a construction in which a scanner (a construction not graphically shown which includes a document table, a light source, an optical system, and an image pickup element for the document scanning, etc.) is provided above the print space 16, a lower surface of the scanner serves as the ceiling surface 17.

The distance (height) between the carriage 32 and the ceiling surface 17 in the up-down direction will be hereinafter also termed the width of the space above the carriage 32 (hereinafter, termed the space width UG). Basically, the space width UG is the distance between the ceiling surface 17 and an uppermost portion of the construction that includes the carriage 32 and the component parts mounted on the carriage 32. For example, if the carriage 32 has a rectangular parallelepiped shape, the distance between the upper surface of the carriage 32 and the ceiling surface 17 is the space width UG. Furthermore, if the carriage 32 has an ink cartridge mounted thereon, the distance between the upper end of the ink cartridge mounted on the carriage 32 and the ceiling surface 17 may be defined as the space width UG.

In this exemplary embodiment, the printing apparatus 10 has a space width adjustment unit 20 capable of adjusting the space width UG. The space width adjustment unit 20 adjusts the space width UG so that the space width UG is larger in the acceleration region in which the carriage 32 is accelerated from the stopped state than in the constant velocity region in which the carriage 32, after being accelerated, is moved at a constant velocity.

Figure 3:
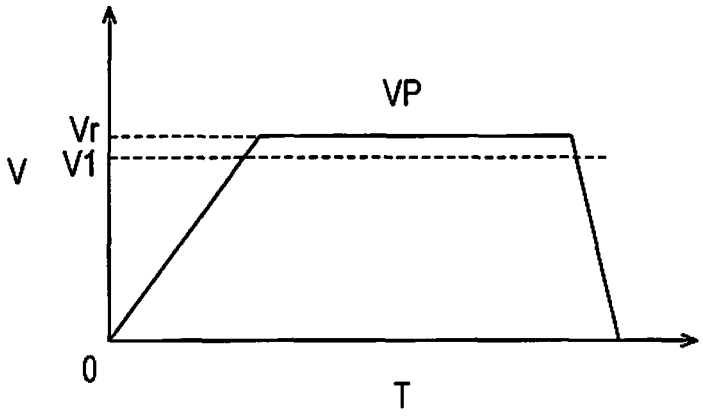
FIG. 3 is a diagram showing an example of a velocity profile.

FIG. 3 shows an example of a velocity profile VP. In the velocity profile VP, the vertical axis represents the velocity V and the horizontal axis represents the time T. As stated above, the carriage velocity at which the carriage 32 moves from the one end side LS to the other end side RS (or moves from the other end side RS to the one end side LS) in the main scanning direction SD is controlled by the control unit 11 so as to become a velocity determined by the velocity profile VP as shown in FIG. 3. As can be seen from the velocity profile VP, the carriage velocity is controlled as follows. That is, the carriage velocity is increased from the stopped state (V=0). After a predetermined target velocity Vr is reached, the target velocity Vr is maintained. Then, the carriage velocity is decreased from the target velocity Vr to the stopped state (V=0).

The interpretation of the terms, such as acceleration region, constant velocity region, and deceleration region, used in this exemplary embodiment do not need to be restrictive. The acceleration region refers to, for example, a range from a position that the carriage 32 assumes at the time point when the carriage 32 starts moving to a position that the carriage 32 reaches in a period that includes at least a portion of the period of acceleration of the carriage 32. Furthermore, the deceleration region refers to, for example, a range from a position at the carriage 32 exists at a given time point following the start of deceleration of the carriage 32 to a position at which the carriage 32 comes to a stop. Furthermore, the constant velocity region refers to a range obtained subtracting the acceleration region and the deceleration region from the range of movement of the carriage 32 from the start until the stop.

As a concrete example, the acceleration region, the constant velocity region, and the deceleration region can be separately defined according to the carriage velocity. For example, the range over which the carriage 32 moves when the carriage velocity increases from 0 to V1 is termed the acceleration region. The velocity V1 is defined as a predetermined velocity slightly lower than the target velocity Vr. Furthermore, the range over which the carriage 32 moves after the carriage velocity exceeds V1 and until the carriage velocity decreases below V1 is termed the constant velocity region. Furthermore, the range over which the carriage 32 moves when the carriage velocity decreases from V1 to 0 is termed the deceleration region.

Alternatively, as another concrete example, the acceleration region, the constant velocity region, and the deceleration region may be divided according to the elapse of time after the carriage 32 starts moving. For example, the range over which the carriage 32 moves after the carriage 32 starts moving and until the elapse of a first time that is needed before the target velocity Vr is reached (a time calculated beforehand on the basis of the velocity profile VP) is termed the acceleration region. Furthermore, the range over which the carriage 32 moves during a second time from when the carriage 32 reaches the target velocity Vr to when the carriage 32 starts to decelerate (a time calculated beforehand on the basis of the velocity profile VP) is termed the constant velocity region. Furthermore, the range over which the carriage 32 moves during a third time from when the carriage 32 starts to decelerate to when the carriage 32 comes to a stop (a time calculated beforehand on the basis of the velocity profile VP) is termed the deceleration region.

Alternatively, as still another concrete example, the acceleration region, the constant velocity region, and the deceleration region may be ranges obtained by dividing the range over which the carriage 32 can move along the main scanning direction SD by distance. For example, in the case where it is assumed that the carriage 32 moves from the outermost position on the one end side LS to the outermost position on the other end side RS of the range in which the carriage 32 can move to perform printing, the range from the outer most position on the one end side LS to the end of a first distance that is needed for the carriage 32 to reach the target velocity Vr after leaving the outermost position on the one end side LS (a distance calculated beforehand on the basis of the velocity profile VP) is termed the acceleration region. Furthermore, the range that follows the acceleration region and that corresponds to a second distance over which the carriage 32 moves after reaching the target velocity Vr and until the carriage 32 starts decelerating (a distance calculated beforehand on the basis of the velocity profile VP) is termed the constant velocity region. Furthermore, the range obtained by subtracting the acceleration region and the constant velocity region from the range from the outermost position on the one end side LS to the outermost position on the other end side RS is termed the deceleration region. Incidentally, the distance between the outermost position on the one end side LS and the outermost position on the other end side RS corresponds to the distance over which the carriage 32 moves in a single scan (pass) when the printing apparatus 10 performs printing on a print medium of the maximum size that the printing apparatus 10 can handle for printing (e.g., A4 size).

As a matter of course, the "constant velocity" mentioned about the carriage velocity is not limited to a perfectly constant velocity. Although the carriage velocity is controlled so as to be kept at a constant velocity (e.g., the target velocity Vr) in the constant velocity region according to the velocity profile VP, the carriage velocity has a deviation from the target velocity Vr at every moment (e.g., every one of the foregoing control steps). Therefore, in view of such actual circumstances of the control of the carriage velocity, the term constant velocity should be understood as one that can include deviations to some extent.

Next, the space width adjustment unit 20 will be described with reference to several examples.

Exemplary Embodiment 1

The space width adjustment unit 2 may have a movable wall 21 that is moved toward above the carriage 32 according to the carriage velocity.

Figure 4:
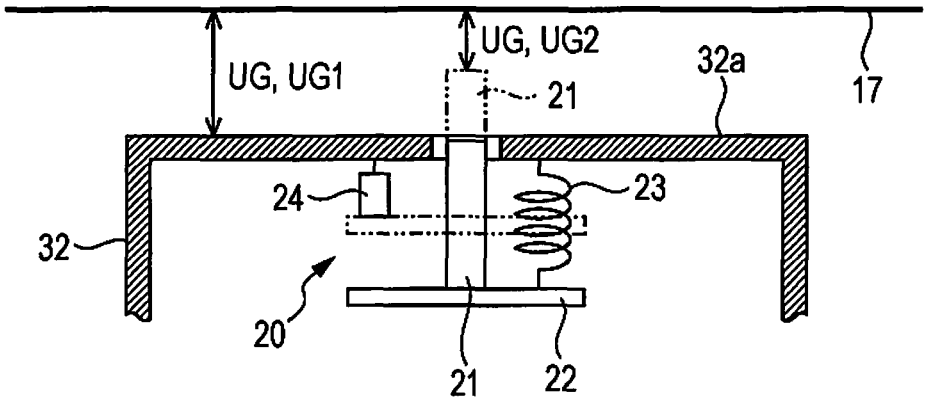
FIG. 4 is a diagram showing a construction example of a space width adjustment unit of Exemplary Embodiment 1.

FIG. 4 plainly shows a construction example of the space width adjustment unit 20 according to Exemplary Embodiment 1 as briefly described above. In FIG. 4, a sectional view of a portion of the carriage 32 that is taken from a viewpoint in the transport direction is shown. The space width adjustment unit 20 is provided in the carriage 32. The space width adjustment unit 20 includes, for example, a flat platy bottom portion 22 and the movable wall 21 standing upward from the bottom portion 22. Furthermore, the space width adjustment unit 20 includes a spring 23 supported between the bottom portion 22 and an upper surface 32*a* of the carriage 32 and also includes an electromagnet 24. The electromagnet 24 is controlled by the control unit 11.

The spring 23 urges the bottom portion 22 in a direction away from the upper surface 32*a* (downward). Therefore, the bottom portion 22 and the movable wall 21 are usually housed within the carriage 32 as illustrated by solid lines in FIG. 4. The position of the movable wall 21 in a state of being housed within the carriage 32 is termed a first position. On the other hand, when the control unit 11 executes a control of supplying a current through the coil of the electromagnet 24, the function of the electromagnet 24 becomes active (the electromagnet 24 functions as a magnet) to attract the bottom portion 22. The bottom portion 22 is made of a magnetic metal or includes a component part made of such a metal. As the bottom portion 22 is attracted to the electromagnet 24, the bottom portion 22 and the movable wall 21 move upward as illustrated by two-dot chain lines in FIG. 4.

The upper surface 32*a* of the carriage 32 is provided with a slit through which the movable wall 21 can pass. The movable wall 21, when moved upward, assumes a state of protruding out of the slit, that is, upward from the carriage 32. Because the movable wall 21 is moved upward in this manner, the space width UG is adjusted to a width (see a space width UG2 shown in FIG. 4) that is smaller than the width of the space before the movement of the movable wall 21 (see a space width UG1 shown in FIG. 4). The position of the movable wall 21 having moved upward as described above is termed a second position. Note that the width of the movable wall 21 in the transport direction is substantially equal to the width of the carriage 32 in the transport direction.

While the carriage 32 is in the acceleration region, the control unit 11 does not activate the function of the electromagnet 24 but keeps the position of the movable wall 21 at the first position. The, at the time the carriage 32 enters the constant velocity region, the control unit 11 activates the function of the electromagnet 24. Therefore, the space width adjustment unit 20 moves the movable wall 21 from the first position to the second position. The control unit 11 is able to determine whether the carriage 32 is presently in the acceleration region or the constant velocity region, by using one of the foregoing concrete examples. For example, the control unit 11 determines that the carriage 32 has entered the constant velocity region from the acceleration region, when the carriage velocity exceeds the velocity V1 (see FIG. 3) afar the carriage 32 starts moving. Then, the control unit 11 activates the function of the electromagnet 24. Note that a combination of the space width adjustment unit 20 and the function of the control unit 11 which determines whether the carriage velocity has exceeded the velocity V1 and accordingly controls the electromagnet 24 may be termed the space width adjustment unit 20. According to Exemplary Embodiment 1 as described above, the space width UG is larger while the carriage 32 is in the acceleration region than after the carriage 32 has entered the constant velocity region. In other words, when the carriage 32 enters the constant velocity region from the acceleration region, the space width UG is reduced.

Exemplary Embodiment 2

The space width adjustment unit 20 may include an erectable portion 25 that is erected toward above the carriage 32 by receiving the head wind that occurs as the carriage 32 moves.

Figure 5:
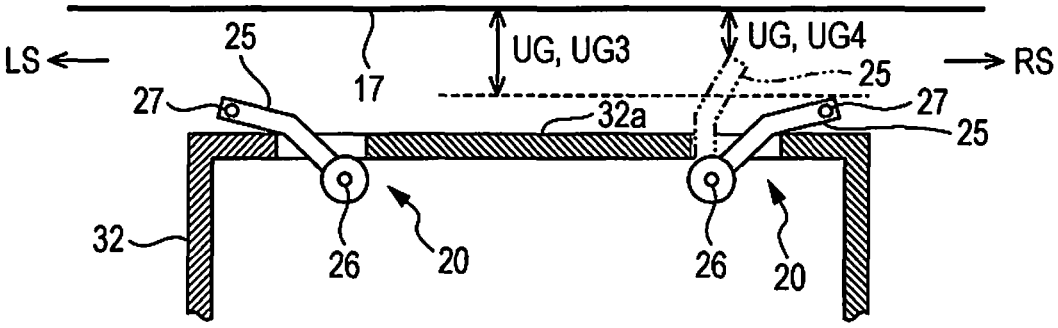
FIG. 5 is a diagram showing a construction example of a space width adjustment unit of Exemplary Embodiment 2.

FIG. 5 plainly illustrates a construction example of the space width adjustment unit 20 according to Exemplary Embodiment 2 as briefly described above. FIG. 5, similar to FIG. 4, shows a sectional view of a portion of the carriage 32 that is taken from a viewpoint in the transport direction. Furthermore, the space width adjustment unit 20 is provided in the carriage 32. The space width adjustment unit 20 includes a shaft 26 that is fixed within the carriage 32 and that lies in the transport direction and an erectable portion 25 that is supported by the shaft 26 so as to be rotatable about the shaft 26. In the example shown in FIG. 5, two space width adjustment units 20 are provided in a left-right symmetric arrangement. That is, the space width adjustment units 20 are provided in the carriage 32, at both the one end side LS and the other end side RS in the main scanning direction SD.

As can be understood from FIG. 5, the erectable portion 25 of each space width adjustment unit 2 is protruded out of the upper surface 32*a* of the carriage 32 through a slit formed in the upper surface 32*a*, except a portion of the erectable portion 25 which includes an end portion connected to the shaft 26. A distal end (upper end) of the erectable portion 25 is provided with a predetermined weight 27. Furthermore, the erectable portion 25 at the one end side LS has a posture in which a predetermined portion that includes the distal end is bent to the one end side LS and the erectable portion 25 at the other end side RS has a posture in which a predetermined portion that includes the distal end is bent to the other end side RS. Therefore, usually, the one-end-side-LS erectable portion 25 is in a state in which the erectable portion 25 has lain (fallen), due to the effect of its weight 27, toward the one end side LS and the other-end-side-RS erectable portion 25 is in a state in which the erectable portion 25 has lain (fallen), due to the effect of its weight 27, toward the other end side RS.

The erectable portion 25 of each space width adjustment unit 20 is erected by receiving head wind when the carriage 32 is in a process of movement. That is, the one-end-side-LS erectable portion 25 is erected by receiving head wind from the one end side LS when the carriage 32 is in the process of moving to the one end side LS. At this time, the other-end-side-RS erectable portion 25 remains in the lying state because of receiving the wind from the one end side LS. On the other hand, the other-end-side-RS erectable portion 25 is erected by receiving head wind from the other end side RS when the carriage 32 is in the process of moving to the other end side RS. At this time, the one-end-side-LS erectable portion 25 remains in the lying state because of receiving from the other end side RS. In FIG. 5, the state in which the other-end-side-RS erectable portion 25 is erected is exemplified by a two-dot chain line. Because either one of the erectable portion 25 becomes erected upward in this manner, the space width UG is adjusted to a width (a space width UG4 indicated in FIG. 5) that is smaller than a pre-erection width (a space width UG3 indicated in FIG. 5). Incidentally, the width of each erectable portion 25 in the transport direction is substantially equal to the width of the carriage 32 in the transport direction. The erectable portions 25 may be called erectable walls, sails, etc.

The head wind that each erectable portion 25 receives becomes stronger with increases in the carriage speed. Therefore, the timing of erection of each erectable portion 25 can be determined beforehand by adjusting the weight of the weight 27. That is, in Exemplary Embodiment 2, it suffices that the distal end of an erectable portion 25 is provided with a weight 27 adjusted in weight beforehand so that the erectable portion 25 would be erected by the force of head wind at a timing at which the carriage 32, after starting to move, enters the constant velocity region (e.g., a timing approximately at which the carriage velocity exceeds the velocity V1). According to Exemplary Embodiment 2 as described above, the space width UG is larger while the carriage 32 is in the acceleration region than after the carriage 32 has entered the constant velocity region. In other words, the space width UG is reduced when the carriage 32 enters the constant velocity region from the acceleration region.

Exemplary Embodiment 3

The space width adjustment unit 20 is not necessarily provided in or on the carriage 32. For example, it is permissible to adopt a construction in which at least a portion of a space width adjustment unit 20 is the ceiling surface 17 that partially defines the space (print space 16) in which the carriage 32 moves and a range in the ceiling surface 17 which corresponds to the constant velocity region is protruded downward.

Figure 6:
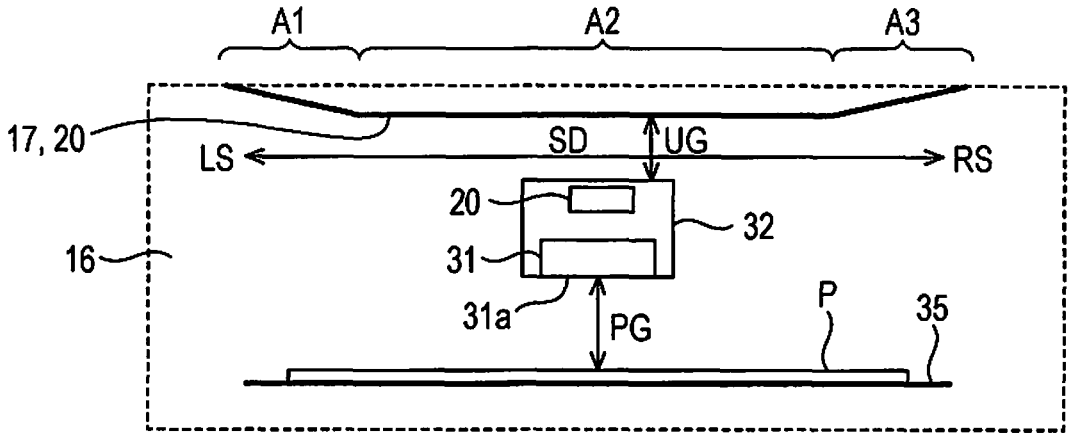
FIG. 6 is a diagram showing a construction example of a space width adjustment unit of Exemplary Embodiment 3.

FIG. 6 plainly illustrates a construction example of a space width adjustment unit 20 according to Exemplary Embodiment 3 as briefly described above. FIG. 6 shows a construction of portions that are in the print space 16, from a viewpoint similar to that in FIG. 2. In Exemplary Embodiment 3, it is assumed that the carriage 32 moves from the outermost position on the one end side LS to the outermost position on the other end side RS and moves from the outermost position on the other end side RS to the outermost position on the one end side LS. In this case, the acceleration region and the constant velocity region for the carriage 32 is divided beforehand by calculation within the range in which the carriage 32 can move to perform printing as described above.

In the example shown in FIG. 6, the ceiling surface 17 is divided into ranges A1, A2 and A3 along the main scanning direction SD. The range A1 corresponds to an acceleration region in the case where the carriage 32 moves from the outermost position on the one end side LS to the outermost position on the other end side RS and the range A2 corresponds to a constant velocity region in the same case. The range A3 corresponds to an acceleration region in the case where the carriage 32 moves from the outermost position on the other end side RS to the outermost position on the one end side LS and the range A2 corresponds to a constant velocity region in the same case. As is apparent from FIG. 6, the range A2 of the ceiling surface 17 is protruded downward from the ranges A1 and A3, that is, protruded toward the carriage 32 with reference to the ranges A1 and A3. On the other hand, the ranges A1 and A3 of the ceiling surface 17 are inclined surfaces that are inclined so as to become higher with increases in distance from the range A2.

According to Exemplary Embodiment 3 as described above, the ceiling surface 17, because of its configuration, functions as a space width adjustment unit 20 to make the space width UG smallest in the range A2 that corresponds to the constant velocity region. That is, the space width UG is larger while the carriage 32 is in the acceleration region than after the carriage 32 has entered the constant velocity region.

Exemplary Embodiment 3 does not rejects a construction in which a space width adjustment unit 20 also exists on the carriage 32 side. That is, Exemplary Embodiment 3 can also be combined with Exemplary Embodiment 1 or Exemplary Embodiment 2.

Advantageous effects of these exemplary embodiment will be explained.

While the carriage 32 is accelerating, the effect of the acceleration brings about a tendency for the airflow below the carriage 32 (through the space between the carriage 32 and the print medium P) to become stronger than when the carriage 32 is moving at a constant velocity. On the other hand, the airflow flowing below the carriage 32 when the carriage 32 is moving is affected by the ratio of the space width UG above the carriage 32 and the space width PG below the carriage 32. That is, if the space width UG is larger, the amount of air that flows in under the carriage 32 out of the amount of air present in front of the carriage 32 is smaller. Conversely, if the space width UG is smaller, a larger amount of air, out of the amount of air present in front of the carriage 32, flows in under the carriage 32.

As described above, these exemplary embodiment secure a relatively large space width UG in the acceleration region for the carriage 32 and reduce the space width UG in the constant velocity region. Due to such constructions, the states of airflow flowing below the carriage 32 in the acceleration region and the constant velocity region can be made substantially equal. As a result, the positional relations between main drops and subsidiary drops at the time of landing can be made substantially uniform between the acceleration region and the constant velocity region, thus restraining occurrence of density unevenness between the print results of these regions.

Furthermore, these exemplary embodiments achieve advantageous effects on restraining occurrence of ripple. The ripple occurs as swirling airflows that occur as the ink is discharged from a nozzle affects the flight of the ink discharged from an adjacent nozzle. Therefore, ripple substantially does not occur immediately after the carriage starts to move, and becomes likely to occur after the carriage 32 has moved to some extent. That is, ripple is more likely to occur in the print result produced in the constant velocity region than in the print result produced in the acceleration region. According to the foregoing exemplary embodiments, in the constant velocity region, the space width UG is reduced so that a sufficiently large amount of airflow flows below the carriage 32. As a result, in the constant velocity region, the airflow from the front of the carriage 32 restrains the occurrence of swirling airflow, so that the print result will not exhibit ripple.

Furthermore, while JP-A-2010-280119 can be said to be able to achieve an advantageous effect only when the carriage is moved to both ends of the movement range, the invention achieves advantageous effects even when the carriage 32 moves inside the two ends of the movement range. Concretely, when the printing apparatus 10 performs printing on a print medium (e.g., a postcard) smaller in size than the maximum size (e.g., the A4 size) of a print medium on which the printing apparatus 10 is capable of printing, the carriage 32 moves back and forth within a partial range in the movement range whose two ends are at the outermost position on the one end side LS and the outermost position on the other end side RS. In such a case, too, particularly Exemplary Embodiment 1 and Exemplary Embodiment 2 are able to make the space width UG different between the acceleration region and the constant velocity region and therefore achieve the foregoing advantageous effects.

As an example included in the foregoing exemplary embodiments, the space width adjustment unit 20 may be configured to make the space width UG smaller than or as small as the paper gap, that is, the space width PG, in the constant velocity region. That is, in the example shown in FIG. 4, at least the space width UG2 is smaller than or equal to the space width PG. In the example shown in FIG. 5, at least the space width UG4 is smaller than or equal to the space width PG. In the example shown in FIG. 6, at least the space width UG in the range A2 is smaller than or equal to the space width PG. In the constant velocity region, reducing the space width UG to a size smaller than or equal to the space width PG makes it possible to certainly cause a large amount of airflow to flow below the carriage 32.

In a more detailed example, according to the foregoing exemplary embodiments, where the space width UG assumed in the acceleration region is represented by UGa and the space width UG assumed in the constant velocity region is represented by UGb, the space width UGb may be smaller than or equal to the space width PG and the space width UGa may be larger than the space width PG and smaller than or equal to 2 times UGb. That is, the printing apparatus 10 may be constructed so as to satisfy $UGb \leq PG < UGa \leq 2UGb$.

The invention is not limited to the foregoing exemplary embodiments but can also be embodied in various forms without departing from the gist of the invention, for example, can adopt modifications as described below.

In Exemplary Embodiment 1, the motive power for moving the movable wall 21 is not limited to the electromagnet 24. For example, the movable wall 21 may be moved by using a motor or the like. Furthermore, the elastic member that urges the movable wall 21 in order to hold the movable wall 21 at the first position is not limited to the spring 23 but may also be, for example, a rubber piece or the like. Furthermore, the movable wall 21, when at the first position, may be in a state in which a portion of the movable wall 21 is protruded above the carriage 32.

Furthermore, the movable wall 21 may be moved stepwise instead of being moved substantially continuously to one of the first position and the second position. For example, the space width adjustment unit 20 may be configured to move the movable wall 21 upward stepwise (gradually) by using a predetermined motive power when the carriage 32 is moving from the acceleration region to the constant velocity region.

In Exemplary Embodiment 2, the one-end-side-LS erectable portion 25 and the other-end-side-RS erectable portion 25 may be integrally constructed.

Figure 7:
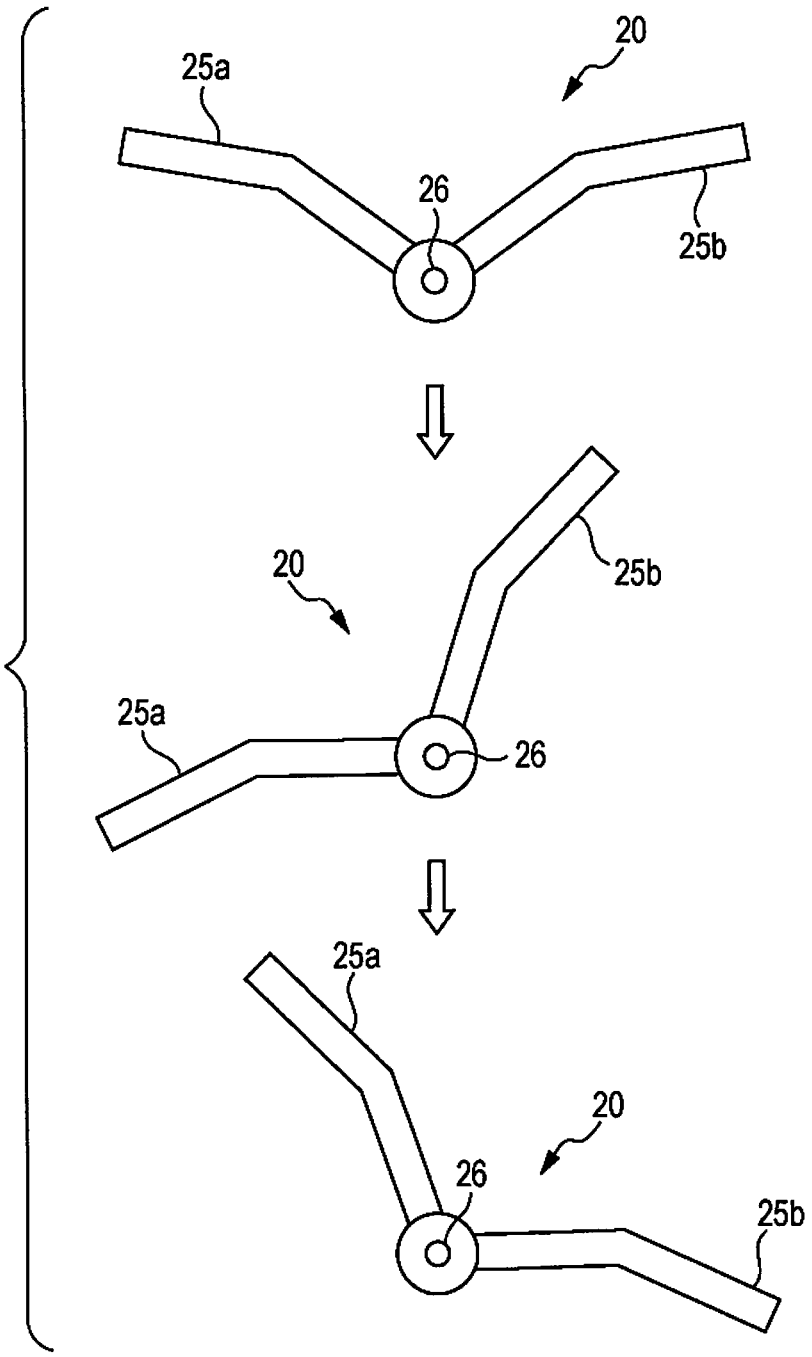
FIG. 7 is a diagram showing a construction example of a space width adjustment unit in which two erectable portions have been integrally formed.

FIG. 7 shows a space width adjustment unit 20 according to a modification as mentioned above. In the example shown in FIG. 7, the space width adjustment unit 20 has two erectable portions 25*a* and 25*b*. The erectable portion 25*a* corresponds to the foregoing one-side-side-LS erectable portion 25 and the erectable portion 25*b* corresponds to the foregoing other-end-side-RS erectable portion 25. The two erectable portions 25*a* and 25*b* are integrally formed and are supported by a common shaft 26 that is fixed to the carriage 32. Although not illustrated in FIG. 7, a distal end (upper end) of each erectable portion 25*a* or 25*b* is provided with a predetermined weight as described above. An upper portion of the FIG. 7 shows a state in which neither one of the erectable portion 25*a* and 25*b* is erected.

An intermediate portion of FIG. 7 shows a state in which the erectable portion 25*b* is erected. The erectable portion 25*b* extending toward the other end side RS becomes erected as shown in the intermediate portion of FIG. 7 by receiving head wind from the other end side RS when the carriage 32 is moving to the other end side RS.

A lower portion of FIG. 7 shows a state in which the erectable portion 25*a* is erected. That is, the erectable portion 25*a* extending toward the one end side LS becomes erected as shown in the lower portion of FIG. 7 by receiving head wind from the one end side LS when the carriage 32 is moving to the one end side LS. According to the foregoing example shown in FIG. 7, the space width adjustment unit 20 that includes two erectable portions can be made compact in construction as a whole.

In Exemplary Embodiment 3, the ceiling surface 17 as a space width adjustment unit 20 is not necessarily formed only by flat surfaces. In the example shown in FIG. 6, the ceiling surface 17 is formed by flat surfaces that include the inclined surfaces that correspond to the range A1 and the range A3. However, the ceiling surface 17 may be partially formed by a curved surface or entirely formed by curved surfaces.

It has been described above that the space width UG is made different between the acceleration region and the constant velocity region for the carriage 32. That is, in the deceleration region subsequent to the constant velocity region, the space width UG is the same as in the constant velocity region (except Exemplary Embodiment 3). Even in the related art, the deceleration region does not exhibit much difference from the constant velocity region in terms of the above-described positional relation between main drops and subsidiary drops at the time of landing. Therefore, the space width UG being the same between the constant velocity region and the deceleration region does not cause a significant problem in image quality. However, the airflow flowing under the carriage 32 does become weaker in the deceleration region than in the constant velocity region. Therefore, in order to realize further securement of improved image quality, the space width UG may be made different between the constant velocity region and the deceleration region.

That is, the space width adjustment unit 20 causes the space width UG to be smaller in the deceleration region than in the constant velocity region (except Exemplary Embodiment 3). For example, because the space width adjustment unit 20 can be controlled so as to move the movable wall 21 by the control unit 11, the position of the movable wall 21 is moved to a higher position at the time the position of the carriage 32 enters the deceleration region from the constant velocity region. By reducing the space width UG in the deceleration region in this manner, sufficient airflow flowing below the carriage 32 can be secured. As a result, small density difference (density unevenness) that occurs between print results produced in the constant velocity region and in the deceleration region can be eliminated. At the same time, in the print results produced in the deceleration region, ripple can be restrained.

This application claims priority under 35 U.S.C. §119 to Japanese Patent Application No. 2015-221879, filed Nov. 12, 2015. The entire disclosure of Japanese Patent Application No. 2015-221879 is hereby incorporated herein by reference.

What is claimed is:

1. A printing apparatus comprising:

a carriage on which a print head is mounted and that discharges an ink from the print head while the carriage is moved along a predetermined direction;

a platen configured and arranged to transport a print medium, the platen being disposed below the carriage; and a space width adjustment unit configured and arranged to cause a width of a space above the carriage within the printing apparatus to be larger in an acceleration region in which the carriage is accelerated from a stopped state than in a constant velocity region in which the carriage is moved at a constant velocity after the acceleration region, the space above the carriage being disposed on an opposite side of the carriage from the platen.

2. A printing apparatus that includes a carriage on which a print head is mounted and that discharges an ink from the print head while moving the carriage along a predetermined direction, the printing apparatus comprising a space width adjustment unit that causes a width of a space above the carriage within the printing apparatus to be larger in an acceleration region in which the carriage is accelerated from a stopped state than in a constant velocity region in which the carriage is moved at a constant velocity after the acceleration region, wherein the space width adjustment unit causes the width of the space above the carriage in the constant velocity region to be smaller than or equal to a paper gap that is a distance between the carriage and a print medium which is below the carriage and which receives the ink discharged from the print head.

3. A printing apparatus that includes a carriage on which a print head is mounted and that discharges an ink from the print head while moving the carriage along a predetermined direction, the printing apparatus comprising a space width adjustment unit that causes a width of a space above the carriage within the printing apparatus to be larger in an acceleration region in which the carriage is accelerated from a stopped state than in a constant velocity region in which the carriage is moved at a constant velocity after the acceleration region, wherein the space width adjustment unit includes a movable wall that is moved in an upward direction in the space above the carriage according to speed of movement of the carriage.

4. A printing apparatus that includes a carriage on which a print head is mounted and that discharges an ink from the print head while moving the carriage along a predetermined direction, the printing apparatus comprising a space width adjustment unit that causes a width of a space above the carriage within the printing apparatus to be larger in an acceleration region in which the carriage is accelerated from a stopped state than in a constant velocity region in which the carriage is moved at a constant velocity after the acceleration region, wherein the space width adjustment unit includes an erectable portion that is erected in an upward direction in the space above the carriage by receiving head wind that occurs according to the movement of the carriage.

5. A printing apparatus that includes a carriage on which a print head is mounted and that discharges an ink from the print head while moving the carriage along a predetermined direction, the printing apparatus comprising a space width adjustment unit that causes a width of a space above the carriage within the printing apparatus to be larger in an acceleration region in which the carriage is accelerated from a stopped state than in a constant velocity region in which the carriage is moved at a constant velocity after the acceleration region, wherein at least a portion of the space width adjustment unit is a ceiling surface of a space in which the carriage moves and the ceiling surface has a shape in which a range that corresponds to the constant velocity region is protruded downward.

6. A printing method comprising:

discharging an ink from a print head mounted on a carriage while the carriage is moved in a predetermined direction transporting a print medium on a platen, the platen being disposed below the carriage; and causing a width of a space above the carriage within an apparatus to be larger in an acceleration region in which the carriage is accelerated from a stopped state than in a constant velocity region in which the carriage is moved at a constant velocity after the acceleration region, the space above the carriage being disposed on an opposite side of the carriage from the platen.

* * * * *